US005423666A

United States Patent [19]

MacMillan

[11] Patent Number: 5,423,666

[45] Date of Patent: Jun. 13, 1995

[54] ANGLE HEAD WITH IMPROVED ACCESSIBILITY

[76] Inventor: Donald M. MacMillan, 3296 Rockhill Avenue, Clearbrook, B.C., Canada, V2S 5J7

[21] Appl. No.: 243,379

[22] Filed: May 16, 1994

[51] Int. Cl.[6] ..... B05C 17/10; B05C 17/12

[52] U.S. Cl. ..... 425/87; 15/235.7; 425/458

[58] Field of Search ..... 425/87, 318, 458; 15/235.7; 249/219.1

[56] References Cited

U.S. PATENT DOCUMENTS

| | | | |
|---|---|---|---|
| 2,824,443 | 2/1958 | Ames | 72/130 |
| 3,056,159 | 10/1962 | Hoveland | 15/235.7 |
| 3,932,101 | 1/1976 | Johnson et al. | 15/235.7 |
| 4,032,283 | 6/1977 | Johnson et al. | 15/235.7 |
| 4,116,604 | 9/1978 | Johnson et al. | 15/235.7 |
| 4,451,223 | 5/1984 | Mower et al. | 425/458 |
| 4,669,970 | 6/1987 | Perry | 15/235.7 |
| 4,757,572 | 7/1988 | Yon | 15/235.7 |
| 4,767,297 | 8/1988 | Mower et al. | 425/87 |
| 5,010,618 | 4/1991 | Croft | 15/235.7 |
| 5,263,836 | 11/1993 | Tinawong | 15/235.7 |

FOREIGN PATENT DOCUMENTS

| | | | |
|---|---|---|---|
| 694673 | 7/1953 | United Kingdom | 249/219.1 |

*Primary Examiner*—Jay H. Woo
*Assistant Examiner*—John Robert Abel
*Attorney, Agent, or Firm*—Robert W. Jenny

[57] ABSTRACT

The portion of the base fixture of the angle head which overhangs the junctures of the frames and the blades in the frames is made adjustable to slide from its in use position to a position which exposes the junctures, facilitating clearing unwanted material from the junctures. The added part fits and slides in a channel made to provide the needed access and is held in place by a thumb screw in a slot. Loosening the screw allows the part to be moved to provide access and moved back to its in use position and locked in that position by tightening the screw.

1 Claim, 2 Drawing Sheets

FIG. 1
PRIOR ART
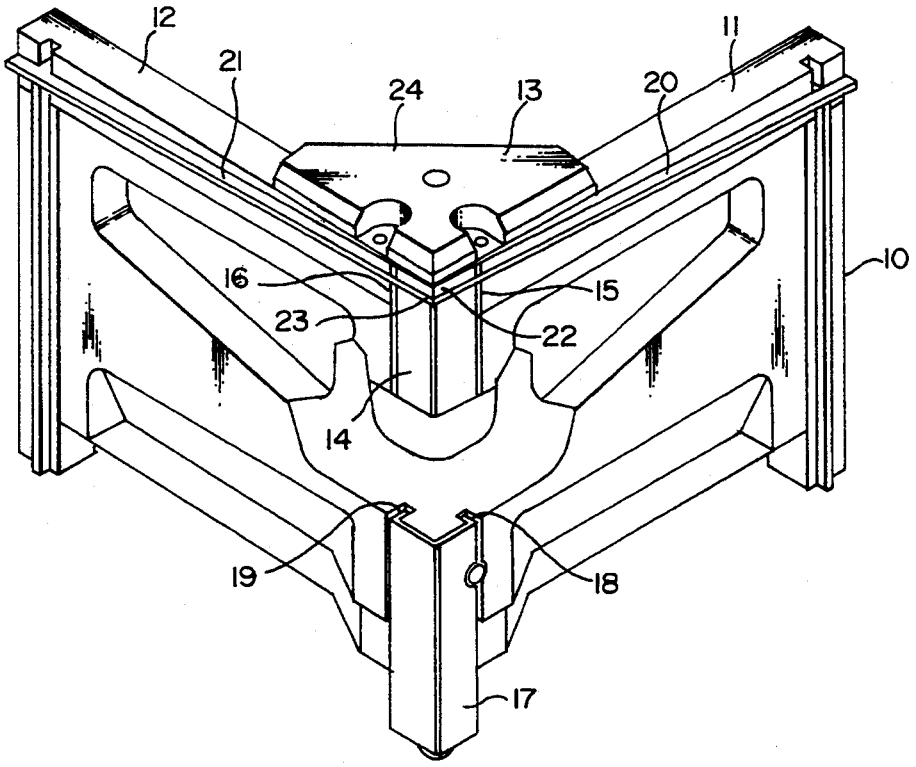
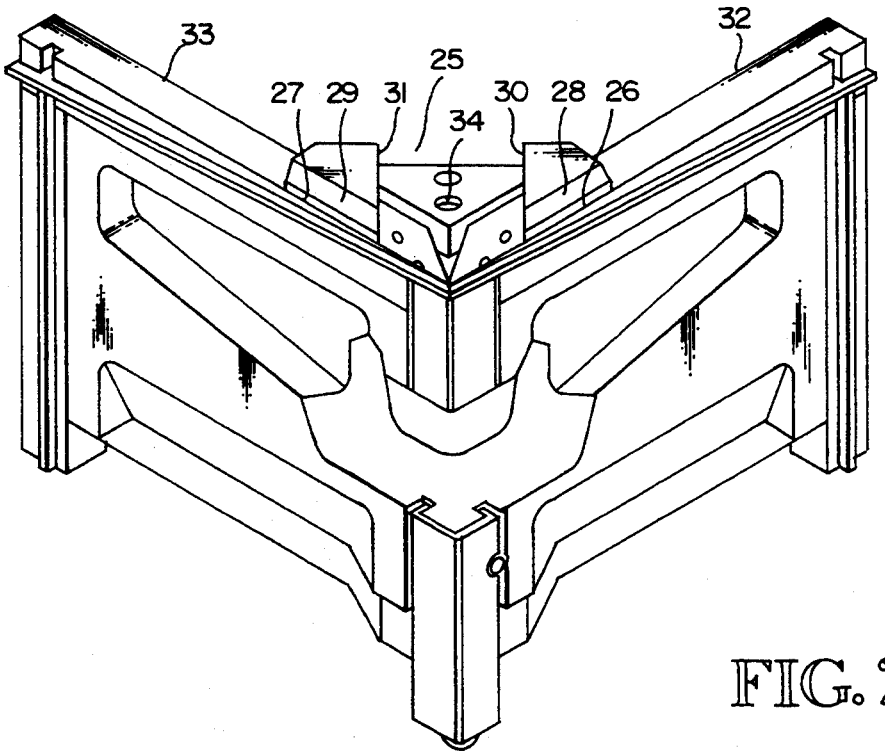
FIG. 2

ANGLE HEAD WITH IMPROVED ACCESSIBILITY

BACKGROUND OF THE INVENTION

1. Field

This invention relates to the field of hand held tools, particularly those which are relatively complicated assemblies. Still more particularly, it is in the field of tool assemblies which use or are used with various compounds such as paints or mastic materials used in the drywall construction industry and termed mud.

2. Prior Art

The prior art to the subject invention is tools used in the drywall construction industry. Such tools require considerable handling and, when indicated, cleaning to provide optimum performance of the tools. The direct prior art to the subject invention is the tool called an angle head, as manufactured by the Concorde Tool Corp. in Surrey, B.C., Canada and Ames Drywall Systems, Inc. in the United States. Angle heads are used to smooth mud applied on corner joints between drywall panels. To adequately accommodate the slight variations in the angles between the panels the frames of the angle head assembly are especially hinged at the center of the working faces of the tool, the center fitting exactly into the corners between panels. Even slight interference with the hinged connection can degrade the quality of the work done with the angle head. Accumulations of small amounts of mud in the mechanism can cause such interference, making it necessary to clear out the accumulations. In the commercially available angle heads such cleaning is difficult without disassembling the tool to some extent. Such disassembly takes time and considerable manual dexterity and experience shows that the loose parts and fasteners can easily be lost or misplaced, especially in work areas. Accordingly, the prime objective of the subject invention is to provide an angle head with improved accessibility to parts and space is which frequently require cleaning. A second objective is that the accessibility be provided without involving any loose parts or fasteners.

SUMMARY OF THE INVENTION

Commercially available angle heads, as marketed by Concorde Tool Corp. in Canada and Ames Drywall Systems, Inc. in the United States comprise frame assemblies pivotally attached to a fixture which in turn is attached to the handle assembly of the tool by a ball joint. The frame assemblies are approximately at 90° to each other and the centerline of the pivotal action is at the apex of the working surfaces of the two assemblies. Blades are mounted in the frame assemblies with one of the ends of each of two of the blades contacting each other at the pivotal centerline. It is essential to the quality of the work done with the angle head that these ends stay in contact and are accurately aligned. It is also important that these ends and surrounding structure be physically protected from contacts which could harm the blades, blade ends and supporting material. To provide this protection the fixture (a casting) comprises a section which, for purposes of this disclosure, is called a nose cone. The nose cone is flat and generally triangular and extends over the conjuncture of the blade ends described above, providing the needed shelter. However, there is a natural tendency for the mastic compound, termed mud, in contact with the tool to become packed in the small spaces between the assemblies and the blade ends, causing unacceptable misalignments. The nose cone blocks the access needed to easily clear the mud from the mechanism. In the subject invention a portion of the conventional nose cone is removed and replaced with a separate part. The part is attached by a threaded fastener having a knurled head. The fastener fits through a slot In the part and the part is guided by the sides of the slot made by the removal of the material. When the fastener is loosened the part can be slid back away from the apex of the head, exposing the mechanism it is provided to protect for easy removal of unwanted material. Once the material is removed the part is moved to its in use position and locked in place by tightening the fastener.

The invention is described in more detail below with reference to the attached drawings.

BRIEF DESCRIPTION OF THE DRAWINGS

FIG. 1 illustrates the assembled parts of a prior art angle head which are involved in the subject invention.

FIG. 2 illustrates the parts of FIG. 1 modified according to the requirements of the subject invention.

DETAILED DESCRIPTION OF THE INVENTION

Figure 3:
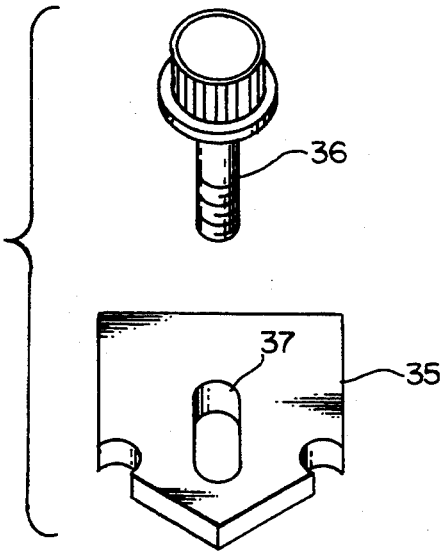
FIG. 3 illustrates the parts added to implement the subject invention.

The subject invention is an angle head having improved accessibility for purposes of clearing unwanted material from specific areas of the head. FIG. 1 illustrates assembled parts of a prior art angle head 10 related to an embodiment of the subject invention. Frame assemblies 11 and 12 are pivotally attached to fixture 13, in part by engagement of clip 14 in slots 15 and 16 and clip 17 in slots 18 and 19. Blades 20 and 21 are installed in assemblies 11 and 12 respectively with end 22 of blade 20 and end 23 of blade 21 in contact with each other. For successful use of the head it is essential that these ends remain in contact. Portion 24 of fixture 13, termed the nose cone for purposes of this disclosure, serves to protect these ends from physical disturbances. However, the mud being worked by the head can become lodged behind the ends of the blades and in related cavities, disrupting the contact between the blade ends and such clogging is difficult to clear out.

FIG. 2 illustrates the assembled parts of FIG. 1 modified to provide access to facilitate clearing away the unwanted material. Channel 25 is cut into the nose cone to the level of surfaces 26 and 27 of overhanging portions 28 and 29. Channel sides 30 and 31 are parallel to a plane bisecting the angle between portions 32 and 33 of fixture 13. Further modification is the drilling and tapping of hole 34 for purposes described below.

FIG. 3 illustrates part 35, which fits into channel 25 and is shaped to replace the material removed in making the channel, and screw 36 which fits through slot 37 in part 35 and engages the threads in hole 34.

Figure 4:
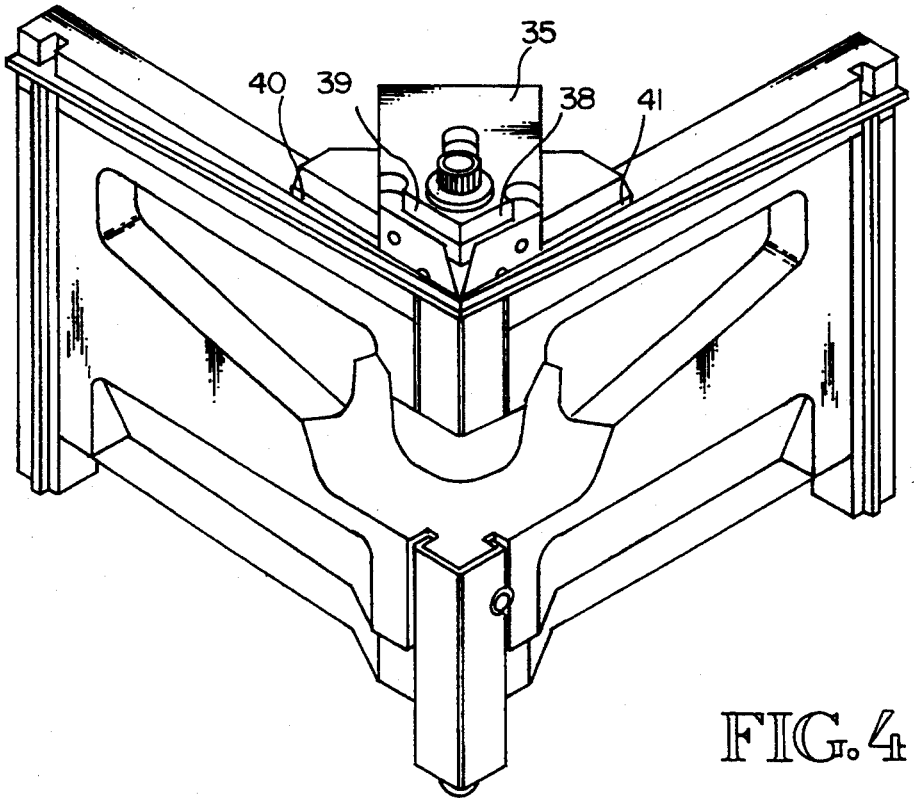
FIG. 4 illustrates the assembled parts of FIG. 1 incorporating the subject invention set to provide access for clearing out undesired material.

FIG. 4 illustrates the angle head according to the subject invention with part 35 moved back from over the ends of the blades, facilitating cleaning around them. In use part 35 is moved so that its exposed surfaces 38 and 39 are aligned with surfaces 40 and 41 of the fixed portion of the nose cone, part 35 being the movable portion.

It is considered to be understandable that the subject invention meets its objectives. It provides an angle head with improved accessibility to parts and spaces which require cleaning and no loose parts are involved.

It is also considered to be understood that while one embodiment of the subject invention is described herein, other embodiments and modifications of the ones disclosed are possible within the scope of the invention which is limited only by the attached claims.

I claim:

1. An angle head having first and second frames, first and second blades in said first and second frames and junctures between said first and second frames and said first and second blades, and said angle head further comprising means adjustable between first and second positions, said first position being an in use position in which said junctures are protected by said means and said second position being such that said junctures are exposed.

* * * * *